United States Patent [19]

Torii

[11] 4,106,874

[45] Aug. 15, 1978

[54] MECHANICAL PENCIL

[75] Inventor: Osamu Torii, Kyoto, Japan

[73] Assignee: Ancos Co., Ltd., Osaka, Japan

[21] Appl. No.: 745,751

[22] Filed: Nov. 29, 1976

[51] Int. Cl.[2] ..... B43K 21/22; B43K 21/20

[52] U.S. Cl. ..... 401/67

[58] Field of Search ..... 401/65–67

[56] References Cited

U.S. PATENT DOCUMENTS

| | | | |
|---|---|---|---|
| 3,437,413 | 4/1969 | Parker | 401/67 |
| 3,450,482 | 6/1969 | Dorstewitz | 401/67 |
| 3,537,799 | 11/1970 | Sakamoto | 401/67 |
| 3,724,960 | 4/1973 | Hashimoto et al. | 401/67 |
| 3,765,781 | 10/1973 | Hashimoto et al. | 401/67 |

*Primary Examiner*—Stephen C. Pellegrino

*Attorney, Agent, or Firm*—Sughrue, Rothwell, Mion, Zinn and Macpeak

[57] ABSTRACT

A mechanical pencil having a mouth piece 5 extendable and retractable in and out of the end portion 3 of a main body 1, and a tip sleeve 14 extendable and retractable in and out of the end portion of the mouth piece 5. The mouth piece is extendable or retractable by fully depressing a push cap 2, while the lead may be inched forward by partially depressing the push cap. The tip sleeve protects the lead, and is designed to automatically move inwardly in response to writing pressure, to thereby always expose the end of the lead for writing.

8 Claims, 7 Drawing Figures

MECHANICAL PENCIL

BACKGROUND OF THE INVENTION

This invention relates to a mechanical pencil having a mouth piece which is extendable and retractable in and out of the main body of the pencil, and a lead enclosing tip sleeve which is similarly extendable and retractable in and out of the front end of the mouth piece. The lead can be extended out of the tip sleeve to a desired length in a step wise manner by the repeated, partial depression of a rear cap, and the tip sleeve automatically yields under writing pressure to keep the writing lead exposed and obviate the need for frequently extending fresh lead.

It is hazardous for a person to carry a mechanical pencil with its mouth piece and tip sleeve extended, since physical injury due to the sharp tip may result and/or the persons clothes may be torn. In order to overcome this hazard U.S. Pat. No. 3,724,960 teaches a mechanical pencil in which the tip sleeve is extended from the main body for writing, but can be retracted within the body when carried by a person. Further, U.S. Pat. No. 3,537,799 teaches a mechanical pencil in which the tip sleeve can be extended and retracted in and out of the end portion of the mouth piece as desired. The tip sleeve of this patent is so designed that the lead can be extended out to a relatively long length, and the tip sleeve automatically moves inwardly in response to writing pressure to keep the end of the lead exposed. Writing can be continued until the tip sleeve is entirely pushed back into the body, whereby it is unnecessary to frequently extend fresh lead during writing.

However, no mechanical pencil combining the two features described above, that is, a mechanical pencil in which the mouth piece and the tip sleeve can be retracted within the body, and in which the tip sleeve can also be extended and retracted in and out of the mouth piece as desired, has yet been proposed.

SUMMARY OF THE INVENTION

These two features are advantageously combined in the present invention. Briefly, a tip sleeve surrounds and protects the extended end of the lead, thereby preventing breakage. The tip sleeve softly grips the lead by a rubber bushing, and slidingly yeilds inwardly to always expose the writing end of the lead as it is consumed.

The tip sleeve is movable in and out of a mouth piece, which is itself movable in and out of the open end of the pencil in response to the full depression of a push cap. The partial depression of the push cap serves to feed out the lead in an intermittent or step wise manner by the advance, release, retraction and reengagement of a lead gripping chuck assembly.

DETAILED DESCRIPTION OF THE PREFERRED EMBODIMENTS

Figure 1:
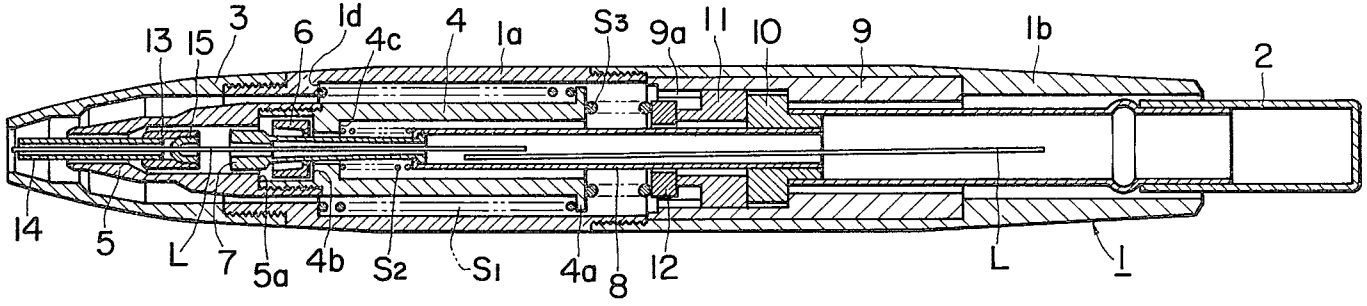
FIG. 1 is a sectional view illustrating a mechanical pencil according to the invention in which the mouth piece and the tip sleeve are retracted within the body.

In FIG. 1, reference numeral 1 designates the main body of a mechanical pencil, which is formed of metal, synthetic resin, or the like into a cylinder having a predetermined diameter and length. This main body consists of a first axial cylinder 1*a* and a second axial cylinder 1*b*. A conical axial mouth member 3 is screwed on the end of the cylinder 1*a*. Inside the axial mouth member 3 is a slidable mouth piece 5, in the end portion of which there is a slider 13 having a tip sleeve 14. A lead holding member 15, made of rubber, synthetic resin, or the like, is press-fitted into the rear end portion of the slider 13.

A shoulder 5*a* is formed on the inner surface of the rear end portion of the mouth piece 5, in which one end of a tightening member receiver 4 is screwed. The tightening member receiver 4 is in the form of a cylinder, and has a spring retaining shoulder 4*a*. A tightening member or chuck sleeve 6 is loosely disposed between the shoulder 5*a* of the mouth piece and a shoulder 4*b* on the tightening member receiver. Into this chuck sleeve 6 is inserted a lead gripping chuck 7 which is longitudinally split into two or three segments in the usual manner. The cam like engagement and disengagement of the chuck 7 and the chuck sleeve 6 allow the lead L to be held and released, respectively.

Figure 2:
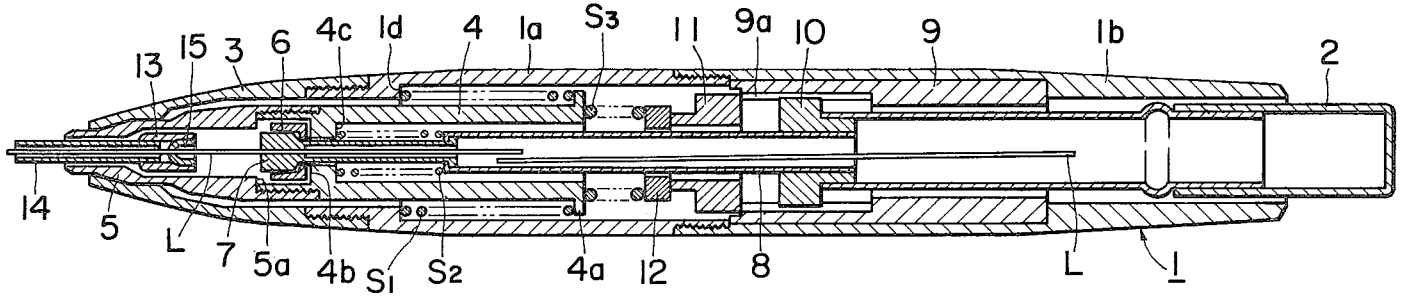
FIG. 2 is a similar sectional view of the same mechanical pencil in which the mouth piece and the tip sleeve are extended for writing.

A lead case 8 is connected to the rear end of the chuck 7, so that a number of pieces of lead L kept in the case are fed one by one into the chuck 7 as required. An annular push member 10 having a protruding annular shoulder on one end is secured to the rear end of the lead case 8. A flange member 11 is rotatably and slidably mounted on the lead case 8 in such a manner that it is positioned between the push member 10 and the rear end of the tightening member receiver 4. A push cap 2, which is greater in diameter than the lead case 8, is connected to the push member 10. The cap serves as a thumb actuated operating member. The flange member 11 has several saw-toothed pawls on its periphery, whose inclined surfaces engage similarly inclined saw-teeth on the shoulder of the push member 10. The pawls and teeth are not shown in the drawings, but are well known in the art. A cylinder 9 has protruding longitudinal ribs 9*a* which engage notches in the push member 10 and the flange member 11, whereby the push member and flange member are axially slidable within the cylinder 9. The push member 10 and flange member 11 are moved forward and backward along the ribs 9*a* of the cylinder 9 under the control of the push cap 2. In operation, once the flange member 11 is pushed out of the cylinder 9 by the full depression of the push cap 2, it is rotatably cammed by the push member teeth bearing against the pawls on the flange member. The push member 10 cannot rotate since its peripheral notches are still engaged by the ribs 9*a*. When the push cap is then released, the notches in the flange member are out of the alignment with the ribs 9*a*, whereby the flange member abuts the ends of the ribs and is retained in its forward position, as shown in FIG. 2. For a more detailed disclosure of this conventional mechanism, see Japanese Patent Publication No. 7181/1959.

A spring S1 is interposed between the shoulder 4*a* at the rear end of the tightening member receiver and a shoulder 1*d* on the inner surface of the cylinder 1*a*. The spring S1 urges the tightening member receiver and the mouth piece 5 into the main body 1 at all times. A further spring S2 is interposed between a shoulder 4*c* on the inner surface of the tightening member receiver 4 and the front end of the lead case 8, whereby the chuck 7 is urged into the chuck sleeve 6 to thereby securely grip the lead L.

Figure 4:
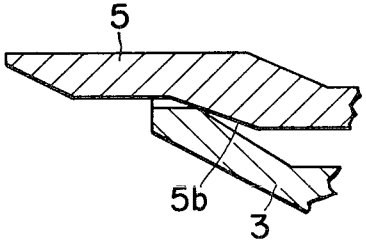

A spring retaining ring 12 is loosely fitted around the lead case 8. A spring S3 is provided between the retaining ring 12 and the rear end of the tightening member receiver 4. This spring S3 may be a leaf spring or a dish type spring instead of the coil spring shown in the drawings. However, it is necessary that the force of spring S3 be greater than that of spring S1. The action of spring S3 causes the tapered outer surface 5*b* of the mouth piece 5 to abut against the inner surface of the front end of the axial mouth member 3 as shown in FIG. 4, whereby the mouth piece 5 is positively supported so that it cannot swing or move laterally during writing.

Figure 5:
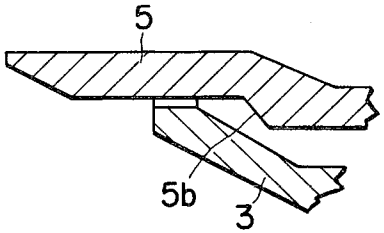
FIG. 4 and FIG. 5 are enlarged views showing the positional relation between the retractable mouth piece and the main body mouth.

If the strength of the spring S1 is suitably balanced with the strength of the spring S3, the mouth piece and the axial mouth piece can be maintained as shown in FIG. 5. Therefore, it is not always necessary to abut the tapered outer surface 5*b* of the mouth piece 5 against the inner surface of the front end portion of the axial mouth piece.

In operation, and to commence writing with the pencil as shown in FIG. 1, the push cap 2 is fully depressed to move forward the internal mechanism including the mouth piece 5, the tip sleeve 14, the tightening member receiver 4, and the lead case 8, to thereby extend the mouth piece 5 and the tip sleeve 14 from the axial mouth member 3, as shown in FIG. 2. This results in the writing condition, whereby the pencil is ready for use. In this condition the tapered section 5*b* of the mouth piece is held abutted against the inner surface of the axial mouth member 3 by the force of the spring S3. When the push cap 2 is fully depressed in this manner, the lead case 8 is first advanced toward the axial front opening while the springs S2 and S1 are being compressed. In this operation, the push member 10 fixed to the lead case is moved forward along the ribs 9*a* on the inner surface of the cylinder 9 so as to push and ultimately rotate the flange member 11, which in turn pushes the tightening member receiver 4 through the spring retaining ring 12 and the spring S3. At the end of the full depression, the spring S3 is also compressed. In other words, when the flange member 11 is pushed out of the ribs 9*a*, the mouth piece 5 is seated and advances no further even though the push member 10 is still depressable to thereby rotate the flange member 11; however, the spring S3 is compressed and remains so due to the abutment and non-return of the flange member 11 when the push cap 2 is released.

As a result of the forward movement of the tightening member receiver 4, the mouth piece 5 is extended from the axial mouth member 3, while the chuck 7 is also moved forward together with the lead case 8. When the chuck 7 is initially moved forward, the chuck sleeve 6 engaged with the chuck is also moved forward until it strikes the shoulder 5*a* of the mouth piece. When the lead case 8 is pushed further, however, the chuck becomes disengaged from the sleeve and releases the lead L. Then, since the lead L is supported by the lead holding member 15 in the slider 13, the lead is moved forward together with the slider 13 and the tip sleeve 14. Thus, the writing condition shown in FIG. 2 is obtained.

When the mouth piece and the other internal elements are at the writing position, the rear portion of the flange member 11 is abutted against the front ends of the ribs 9*a*, as shown in FIG. 2. In this condition, the springs S3 and S1 are compressed, and the tapered portion 5*b* of the mouth piece is tightly held against the inner surface of the front end of the axial mouth member 3. However, when the push cap 2 is released, the spring S2 is immediately restored or extended, to thereby reengage the chuck with the chuck sleeve to grip the lead. As the lead is consumed in writing, the tip sleeve 14 automatically moves inwardly by reason of the holding member 15 sliding on the lead L. This serves to always protect the lead from breakage, and at the same time expose some lead at the end of the tip sleeve for writing.

Figure 3:
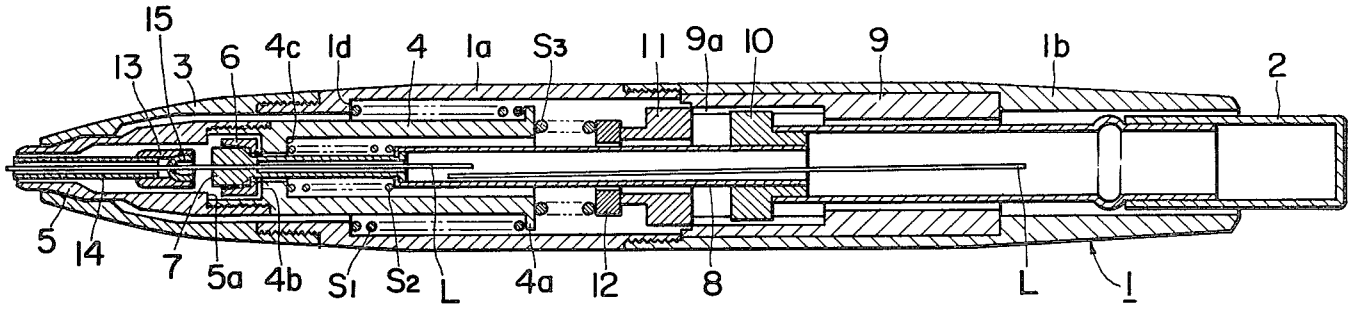
FIG. 3 is a sectional view of the pencil in the writing state, wherein the tip sleeve has moved inwardly or backward to expose fresh writing lead.

When the lead is consumed to the end of the mouth piece, the pencil is in the state shown in FIG. 3. If the push cap 2 is then slightly or only partially depressed, only the spring S2 is compressed, as a result of which only the lead case 8 and the lead gripping assembly are moved forward to thereby extend some new lead. That is, the chuck 7 and sleeve 6 move forward to advance the lead until the sleeve 6 strikes the shoulder 5*a* and releases the chuck. When the cap 2 is released the lead remains advanced, and the chuck and sleeve retract to regrip the lead at a higher position. The lead may be intermittently or step wise advanced in this manner to any desired length by repeatedly "pumping" the push cap.

When the cap 2 is fully depressed after writing, the push member 10 pushes the flange member 11, and the spring S3 is compressed. As a result, the flange member 11 is moved forward, rotated so that its notches are once more aligned with the ribs 9*a*, and when the push cap is released the flange member retracts into the cylinder 9. The internal mechanism is also moved backward in its entirety by the force of spring S1, and the tip sleeve 14 and mouth piece 5 are pulled in to restore the mechanical pencil to the state shown in FIG. 1. When the strength of spring S1 is greater than that of spring S2, the chuck 7 does not engage the chuck sleeve 6; that is, the lead is released. However, when the strength of spring S1 is weakened, the chuck is engaged with its sleeve by the action of spring S2, and the lead is thus held even when the mouth piece 5, etc., as described above, have been pulled in.

As the force of spring S3 is designed to be greater than the writing pressure force, the spring S3 is never compressed during writing. Furthermore, the spring S3 is designed so that it does not elongate at room temperature, whereby it can be positively and safely built into the pencil.

The forward-backward movement mechanism for locking the various elements at the forward or backward position can be made in accordance with a variety of well-known designs. The mechanism employed in the embodiment disclosed herein is one of these conventional designs. Besides this mechanism, there is a forward-backward movement mechanism which comprises a rotary cam having a push member, wherein the rotary cam and the internal structure of the body are different in configuration. There is also a mechanism which comprises a heart-shaped groove provided in the side of a push cylinder, a lateral groove in the inner surface of the body, and a ball rotatably inserted between these grooves, and wherein the ball is moved in the heart-shaped groove by pushing the cylinder in such a manner that the cylinder is locked at the forward position by the first depression and at the backward position by the second depression. See, for example, Japanese Utility Model Publication No. 2113/1964. Any of these conventional mechanisms can be applied to this invention.

Figure 6:
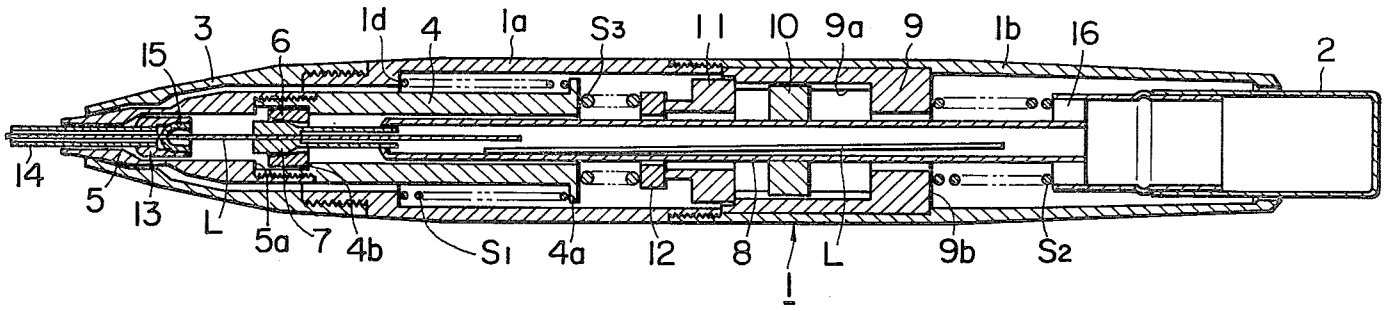
FIG. 6 is a sectional view illustrating another embodiment of a mechanical pencil according to the present invention.

In the embodiment shown in FIGS. 1 through 3, the spring S2 is positioned between the tightening member receiver 4 and the lead case 8; however, the spring S2 may also be positioned between the cam cylinder and a ring provided at the front end of the push cap 2, as shown in FIG. 6. In all cases, a spring is placed to urge the lead case and the chuck inwardly and thereby grip the lead L.

Figure 7:
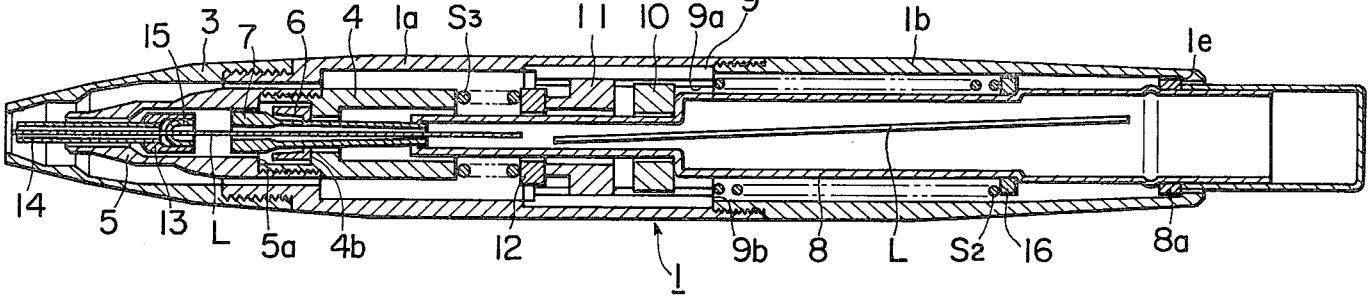
FIG. 7 is a sectional view illustrating still another embodiment of the invention, employing only two springs.

In the embodiments of FIGS. 1–6, a spring $S_1$ is positioned between the tightening member receiver 4 and the body 1 to urge the internal mechanism, including the receiver 4 and the mouth piece 5, into the body. The spring $S_1$ may be omitted, however, as shown in the embodiment of FIG. 7, wherein an elongated spring $S_2$ positioned between the end shoulder **9*b* of the cam cylinder 9 and a stop ring 16 mounted on the lead case 8. If the spring $S_2$ is sufficiently long, it serves the dual functions of both tightening or engaging the lead gripping chuck 7 and urging the receiver 4 and mouth piece 5 into their retracted position within the body. The lead case 8 is retained within the body by a stop ring 8*a* thereon engaging an inturned flange or shoulder 1*e* on the body 1**.

According to this invention, the following advantageous features are provided:

(1) No lateral "rattling" is possible between the axial mouth member 3 and the mouth piece 5, which facilitates smooth writing.

(2) The mouthpiece 5 is only moved a short distance to be locked at the forward position. Therefore, the length of the mouth piece protruding from the axial mouth member is short, and the chuck is well advanced toward the front of the pencil.

(3) It is unnecessary to move the mouth piece whenever the push cap is fully depressed, and therefore unnecessary vibration of the mouth piece is eliminated.

What is claimed is:

1. A mechanical pencil, comprising:

(a) an elongated hollow main body member defining a mouth opening at one end thereof, (b) a mouth piece movable in and out of the mouth opening, (c) a chuck receiver axially secured to one end of the mouth piece to define an annular recess therebetween and positioned within the body member, (d) a chuck sleeve slidably positioned in the annular recess, (e) a lead gripping chuck positioned within the chuck sleeve, (f) an elongated lead case secured to one end of the chuck and slidably positioned within the body member and the chuck receiver, (g) first spring means for urging the chuck into lead gripping engagement with the chuck sleeve and the chuck receiver inwardly with respect to the mouth opening, (h) a push operated mechanism slidably positioned within the body member for locking the mouth piece, chuck receiver, chuck receiver, chuck sleeve, chuck and lead case in retracted and extended positions with respect to the mouth opening, (i) second spring means positioned between the chuck receiver and the mechanism for urging the two apart, and, (j) a secured to the lead case push cap for implementing the longitudinal movement of the lead case and mechanism.

2. A mechanical pencil as defined in claim 1, wherein the first spring means comprises a first spring positioned between the body member and the chuck receiver for urging the latter away from the mouth opening, and a second spring positioned between the chuck receiver and the lead case for urging the two apart.

3. A mechanical pencil as defined in claim 1, wherein the first spring means comprises a first spring positioned between the body member and the chuck receiver for urging the latter away from the mouth opening, and a second spring positioned between the main body and the push cap for urging the two apart.

4. A mechanical pencil as defined in claim 1, wherein the first spring means comprises an elongated coil spring positioned between the push operated mechanism and the lead case for urging the two apart.

5. A mechanical pencil as defined in claim 1, further comprising a tip sleeve movable in and out of the mouth piece, the tip sleeve protectively surrounding one end of a writing lead and including a resilient bushing for frictionally gripping the lead.

6. A mechanical pencil as defined in claim 2, further comprising a tip sleeve movable in and out of the mouth piece, the tip sleeve protectively surrounding one end of a writing lead and including a resilient bushing for frictionally gripping the lead.

7. A mechanical pencil as defined in claim 3, further comprising a tip sleeve movable in and out of the mouth piece, the tip sleeve protectively surrounding one end of a writing lead and including a resilient bushing for frictionally gripping the lead.

8. A mechanical pencil as defined in claim 4, further comprising a tip sleeve movable in and out of the mouth piece, the tip sleeve protectively surrounding one end of a writing lead and including a resilient bushing for frictionally gripping the lead.

* * * * *